US008763861B2

(12) United States Patent
Ashmead et al.

(10) Patent No.: US 8,763,861 B2
(45) Date of Patent: Jul. 1, 2014

(54) DISPENSING DEVICE HAVING AN ARRAY OF CONCENTRIC TUBES

(75) Inventors: James William Ashmead, Middletown, DE (US); William Gerald DiMaio, Garnet Valley, PA (US)

(73) Assignee: Actamax Surgical Materials, LLC, Berkeley, CA (US)

( * ) Notice: Subject to any disclaimer, the term of this patent is extended or adjusted under 35 U.S.C. 154(b) by 5 days.

(21) Appl. No.: 13/516,422

(22) PCT Filed: Dec. 17, 2010

(86) PCT No.: PCT/US2010/060918

§ 371 (c)(1),
(2), (4) Date: Sep. 4, 2012

(87) PCT Pub. No.: WO2011/093954

PCT Pub. Date: Aug. 4, 2011

(65) Prior Publication Data

US 2013/0020352 A1 Jan. 24, 2013

Related U.S. Application Data

(60) Provisional application No. 61/287,372, filed on Dec. 17, 2009, provisional application No. 61/287,367, filed on Dec. 17, 2009, provisional application No. 61/287,352, filed on Dec. 17, 2009, provisional application No. 61/287,359, filed on Dec. 17, 2009.

(51) Int. Cl.
*B01F 5/00* (2006.01)

(52) U.S. Cl.
CPC ..... *B01F 5/0082* (2013.01)
USPC ..... 222/143; 239/424; 604/82

(58) Field of Classification Search
CPC B05B 7/06; B05B 7/061; A61B 2017/00495; B01F 5/0082; B01F 5/0453
USPC ..... 222/145.5, 143, 129, 330; 604/82; 239/549, 416.4, 416.5, 424; 401/23, 35
See application file for complete search history.

(56) References Cited

U.S. PATENT DOCUMENTS 622,482 A * 4/1899 Jackson ..... 239/549
3,038,785 A * 6/1962 Braude et al. ..... 423/413

(Continued)

FOREIGN PATENT DOCUMENTS

EP 0669100 8/1995
EP 1623760 2/2006

(Continued)

OTHER PUBLICATIONS

Definition of Oxyhydrogen from Wikepedia, the free encyclopedia, dated Jan. 23, 2014, pp. 1-5.

(Continued)

*Primary Examiner* — Paul R Durand
*Assistant Examiner* — Charles P Cheyney
(74) *Attorney, Agent, or Firm* — McCarter & English, LLP

(57) ABSTRACT

A device for dispensing individual components of a two-component adhesive includes first and second manifold members, each having a distribution chamber therein. A set of conveying tubes is supported within the dispensing device and collectively present a predetermined total cross-sectional flow area to the first distribution chamber. The second manifold member has an array of passages therethrough. Each tube extends substantially concentrically through a respective passage to define annular flow spaces that collectively present a predetermined total cross-sectional flow area to the second distribution chamber member. First and second components emanating from the tubes and the flow spaces are able to intermix with and diffuse into each other on the discharge area of the second manifold member. The cross-sectional flow areas presented to the first and second distribution chambers are equal.

17 Claims, 8 Drawing Sheets

(56) References Cited

U.S. PATENT DOCUMENTS

| | | | | |
|---|---|---|---|---|
| 3,204,682 | A | 9/1965 | Teleshefsky et al. | |
| 3,876,149 | A * | 4/1975 | Futerko | 239/398 |
| 5,605,541 | A * | 2/1997 | Holm | 604/82 |
| 5,609,301 | A * | 3/1997 | Burke et al. | 239/423 |
| 5,800,538 | A * | 9/1998 | Slepian et al. | 128/898 |
| 5,803,600 | A | 9/1998 | Schubert et al. | |
| 6,082,891 | A | 7/2000 | Schubert et al. | |
| 6,132,079 | A | 10/2000 | King | |
| 6,253,539 | B1 * | 7/2001 | Farhangi et al. | 60/211 |
| 6,305,834 | B1 | 10/2001 | Schubert et al. | |
| 6,321,998 | B1 | 11/2001 | Schubert et al. | |
| 6,773,414 | B2 | 8/2004 | Ljungquist | |
| 6,863,867 | B2 | 3/2005 | Vanden Bussche et al. | |
| 7,046,357 | B2 | 5/2006 | Weinberger et al. | |
| 7,147,364 | B2 | 12/2006 | Oohashi et al. | |
| 7,192,562 | B1 | 3/2007 | Towler et al. | |
| 8,192,703 | B2 | 6/2012 | Ban et al. | |
| 8,246,241 | B2 | 8/2012 | Ashmead et al. | |
| 8,277,113 | B2 | 10/2012 | Ashmead et al. | |
| 8,523,805 | B2 * | 9/2013 | Chavarria | 604/82 |
| 2001/0048637 | A1 | 12/2001 | Weigl et al. | |
| 2003/0039169 | A1 | 2/2003 | Ehrfeld et al. | |
| 2006/0087918 | A1 | 4/2006 | Ji et al. | |
| 2007/0160890 | A1 | 7/2007 | Fischer | |
| 2009/0314416 | A1 | 12/2009 | Ashmead et al. | |

FOREIGN PATENT DOCUMENTS

| | | |
|---|---|---|
| EP | 1908514 | 4/2008 |
| GB | 1333531 | 10/1973 |
| WO | 2011/018521 | 2/2011 |

OTHER PUBLICATIONS

Definition of "Manifold", Dictionary of Mechanical Engineering, Fourth Edition, 2 Pages, Jan. 1996.

* cited by examiner

DISPENSING DEVICE HAVING AN ARRAY OF CONCENTRIC TUBES

CROSS-REFERENCE TO RELATED APPLICATIONS

This application is a 35 U.S.C. §371 national stage filing of International Application No. PCT/US2010/060918, which claims the benefit of and priority under 35 U.S.C. §119 to U.S. Provisional Application Ser. Nos. 61/287,372; 61/287,367; 61/287,352 and 61/287,359, all of which were filed Dec. 17, 2009. The entire contents of each of the foregoing applications are incorporated herein by reference.

BACKGROUND OF THE INVENTION

1. Field of the Invention

This invention relates to an apparatus used in the dispensing of fast-setting multi-component adhesives, particularly medical adhesives.

2. Description of the Prior Art

A fast-setting two-component adhesive is an adhesive compound that cures within seconds of the components being mixed together. Such fast-setting two-component adhesives have many applications, including use as tissue adhesives for a number of potential medical applications. Such potential medical applications include closing topical wounds, adhering synthetic onlays or inlays to the cornea, delivering drugs, providing anti-adhesion barriers to prevent post-surgical adhesions, and supplementing or replacing sutures or staples in internal surgical procedures.

The components of such fast-setting two-component adhesives must be mixed at the site of application or immediately (i.e., typically within a few seconds) before application. Conventional static mixers have been employed to mix the two components together as the adhesive is applied to the tissue. These conventional static mixers typically employ a serpentine passage. The mixing action occurs within the serpentine passage before the adhesive exits the mixing passage. Representative of such conventional static mixer are those devices sold by Med Mix Systems AG, Rotkreuz, Switzerland and Mix Tek System LLC, New York, N.Y.

U.S. Pat. No. 5,595,712, assigned to E.I. DuPont DeNemours and Company, also disclose a static mixing device employing a serpentine passage within a planar structure.

These prior art static mixers are believed disadvantageous for use in any medical application which requires intermittent application of adhesive. If flow of the adhesive through the mixer is interrupted, even momentarily, the mixed components rapidly increase in viscosity. This increase in viscosity, known as gelling, may occur so rapidly that the mixer passage becomes clogged, thus preventing the resumption of flow of the adhesive.

Besides the static mixers previously described, dynamic mixers such as powered impellers and magnetic stir bars have been used. However these devices are costly and cumbersome and not particularly amenable to medical use as they may damage the adhesive by over-mixing.

Accordingly, in view of the foregoing there is believed to be a need for a dispensing device capable of delivering the individual components of a fast-setting multi-component adhesive without experiencing the clogging problems of prior art devices.

SUMMARY OF THE INVENTION

The present invention is directed to a dispensing device for dispensing individual components of an adhesive containing at least two components. The dispensing device comprises a first and a second manifold member, each manifold member having a distribution chamber therein. A portion of the exterior surface of the second manifold member has a discharge area defined thereon. A supply port is disposed in fluid communication with a respective one of the first and second distribution chambers. Each supply port is adapted to receive one of the components of the adhesive and to convey the same into the distribution chamber within its respective associated manifold member.

A set of conveying tubes, each having a supply end and a discharge end, is supported within the dispensing device such that the supply end of each is disposed in fluid communication with the first distribution chamber. The conveying tubes collectively present a predetermined total cross-sectional flow area to the first distribution chamber.

In a first embodiment of the invention the second manifold member has an array of openings and an array of passages extending therethrough. Both the openings and the passages communicate with the discharge surface. The openings receive the discharge ends of the conveying tubes. The passages are disposed in fluid communication with the second distribution chamber. The passages may, if desired, be lined by a tubular liner. The passages (whether lined or unlined) collectively present a predetermined total cross-sectional flow area to the second distribution chamber member.

The openings and the passages are laterally spaced with respect to each other over the discharge area such that the discharge ends of the tubes (received within the openings) are interspersed among the passages whereby first and second components emanating from the tubes and passages are able to intermix with and diffuse into each other to a degree sufficient to cause a gellation action therebetween on the discharge area of the second manifold member.

In a second embodiment of the present invention each tube extends substantially concentrically through a respective passage (lined or unlined) in the second manifold member, thereby to define a substantially annular flow space within the passage. Each annular flow space is disposed in fluid communication with the second distribution chamber member. The annular flow spaces collectively present a predetermined total cross-sectional flow area to the second distribution chamber member. First and second components emanating from the tubes and the flow spaces are able to intermix with and diffuse into each other on the discharge area of the second manifold member.

Each of the first or second embodiments of the invention may be implemented in alternative versions.

In one version the predetermined total cross-sectional flow area collectively presented to the first distribution chamber by the conveying tubes is sized to substantially equal the predetermined total cross-sectional flow area collectively presented to the second distribution chamber member by either the passages (whether lined or unlined) or by the annular flow spaces (as the case may be). Using this version of the either embodiment, assuming that the components are introduced into the first and second distribution chambers with respective equal introductory flow rates, the volumes of the components emanating from the tubes and passages or emanating from the tubes and flow spaces are substantially equal.

In an alternative version of either embodiment the predetermined total cross-sectional flow area collectively presented to the first distribution chamber by the conveying tubes is different from the total cross-sectional flow area collectively presented to the second distribution chamber member by either the passages (whether lined or unlined) or by the annular flow spaces (as the case may be). That is to say, the predetermined total cross-sectional flow area collectively presented to the first distribution chamber by the conveying tubes may be greater than or less than the total cross-sectional flow area collectively presented to the second distribution chamber member by either the passages (whether lined or unlined) or by the annular flow spaces (as the case may be).

For example, if the total cross-sectional flow area presented to the first distribution chamber by the tubes is greater than the total cross-sectional flow area presented to the second distribution chamber by the passages the ratio of the total cross-sectional flow area presented to the first distribution chamber by the tubes with respect to the total cross-sectional flow area presented to the second distribution chamber by the passages is at least (1.25:1).

Otherwise, if the total cross-sectional flow area presented to the first distribution chamber by the tubes is less than the total cross-sectional flow area presented to the second distribution chamber by the passages the ratio of the total cross-sectional flow area presented to the first distribution chamber by the tubes with respect to the total cross-sectional flow area presented to the second distribution chamber by the passages is at least (1:1.25).

Using the structural arrangement of the alternative version, again assuming equal introductory flow rates of components into the distribution chambers, the ratio of the first to second components emanating from the tubes and passages or emanating reflects the ratio of the flow areas.

Moreover, when either version is applied to either embodiment the ratio of the emanating components may be adjusted with respect to each other by changing the introductory flow rate of one component with respect to the introductory flow rate of that other component.

BRIEF DESCRIPTION OF THE DRAWINGS

The invention will be more fully understood from the following detailed description, taken in connection with the accompanying Figures, which form a part of this application and in which.

DETAILED DESCRIPTION OF THE INVENTION

Figure 1:
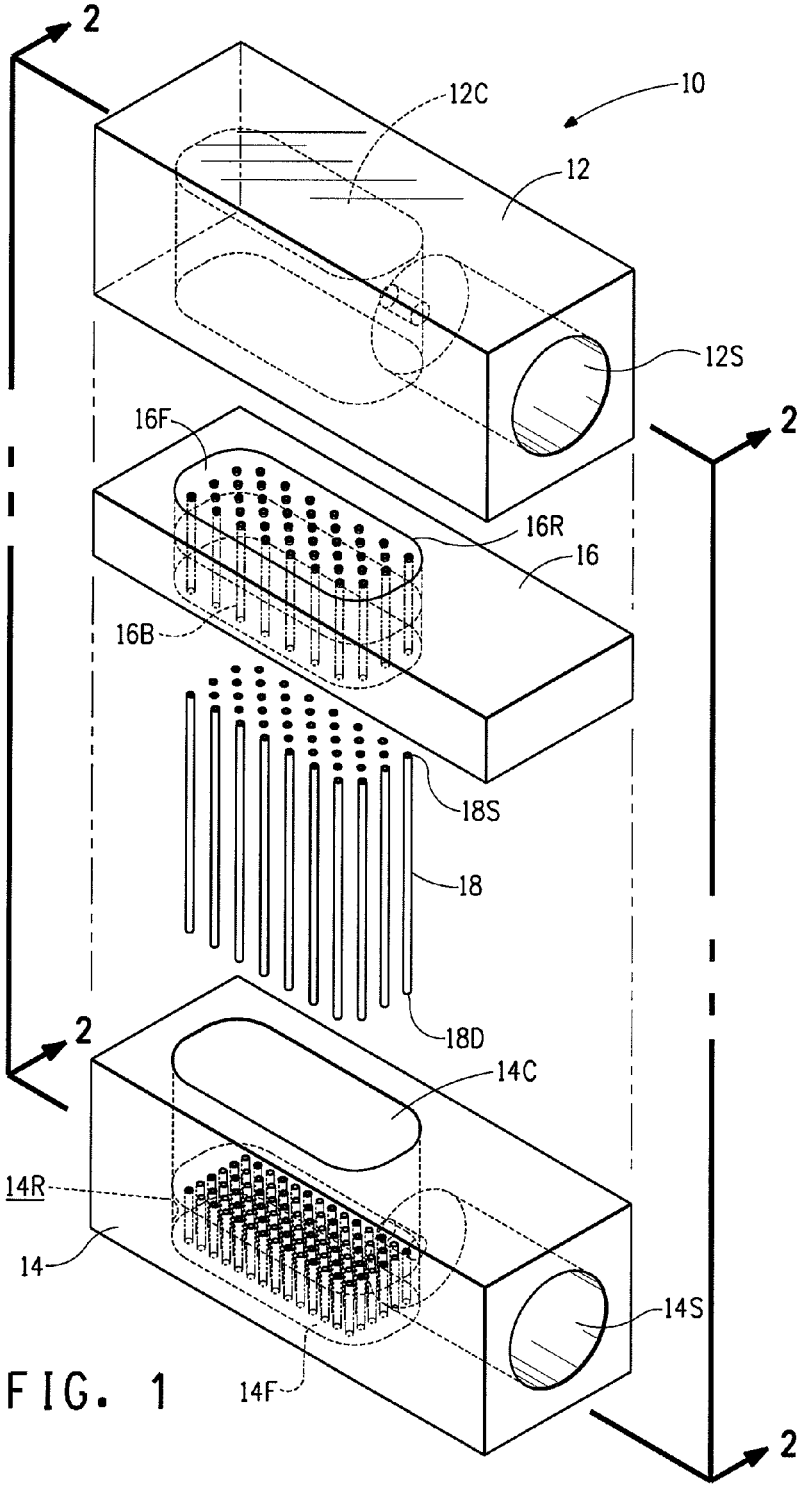
FIG. 1 is an exploded perspective view of a dispensing device in accordance with a first embodiment of the present invention.

Throughout the following detailed description similar reference numerals refer to similar elements in all figures of the drawings.

Figure 6:
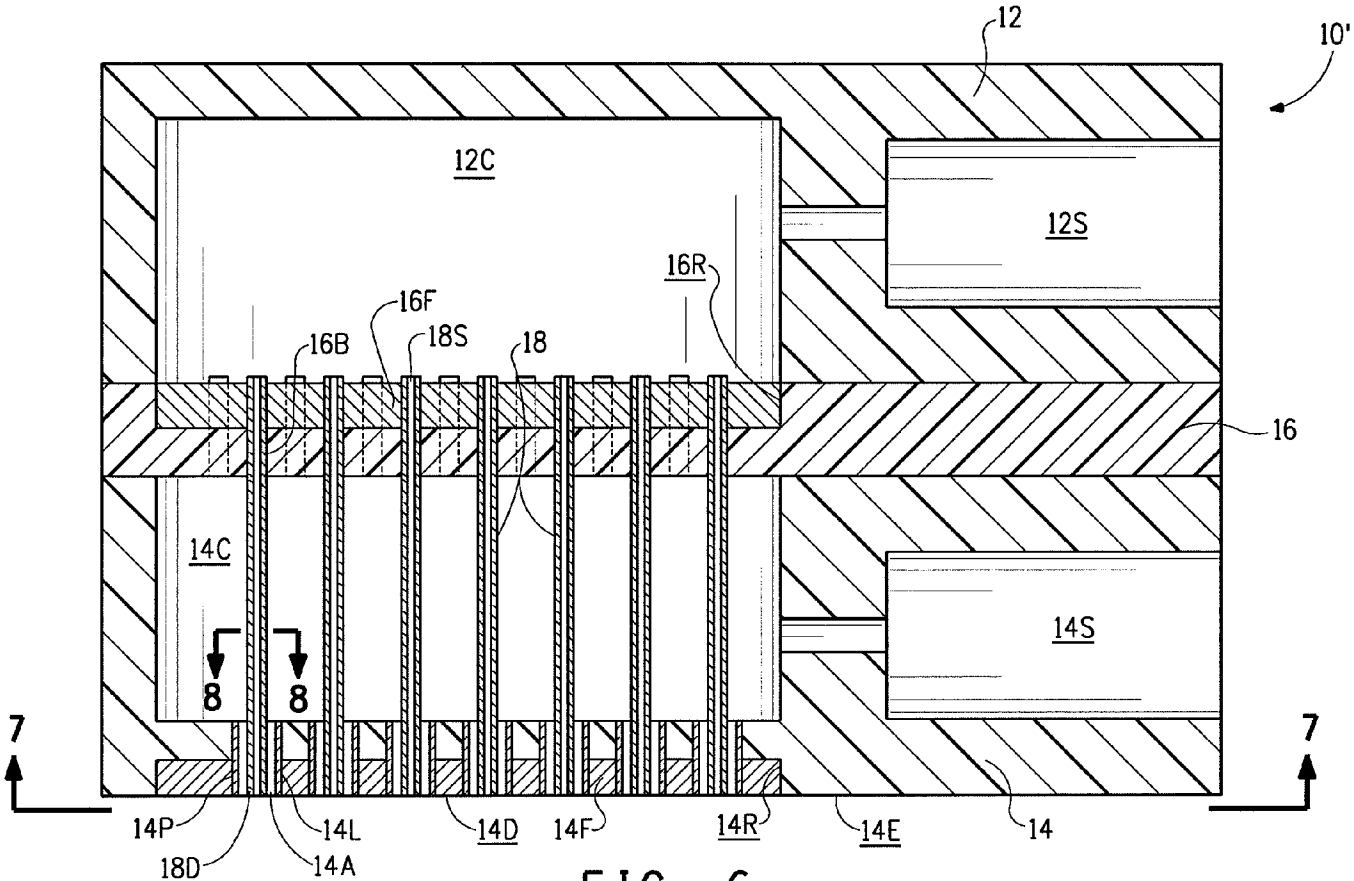
FIG. 6 is a section view similar to that shown in FIG. 2 illustrating a second embodiment of the present invention.
Figure 7:
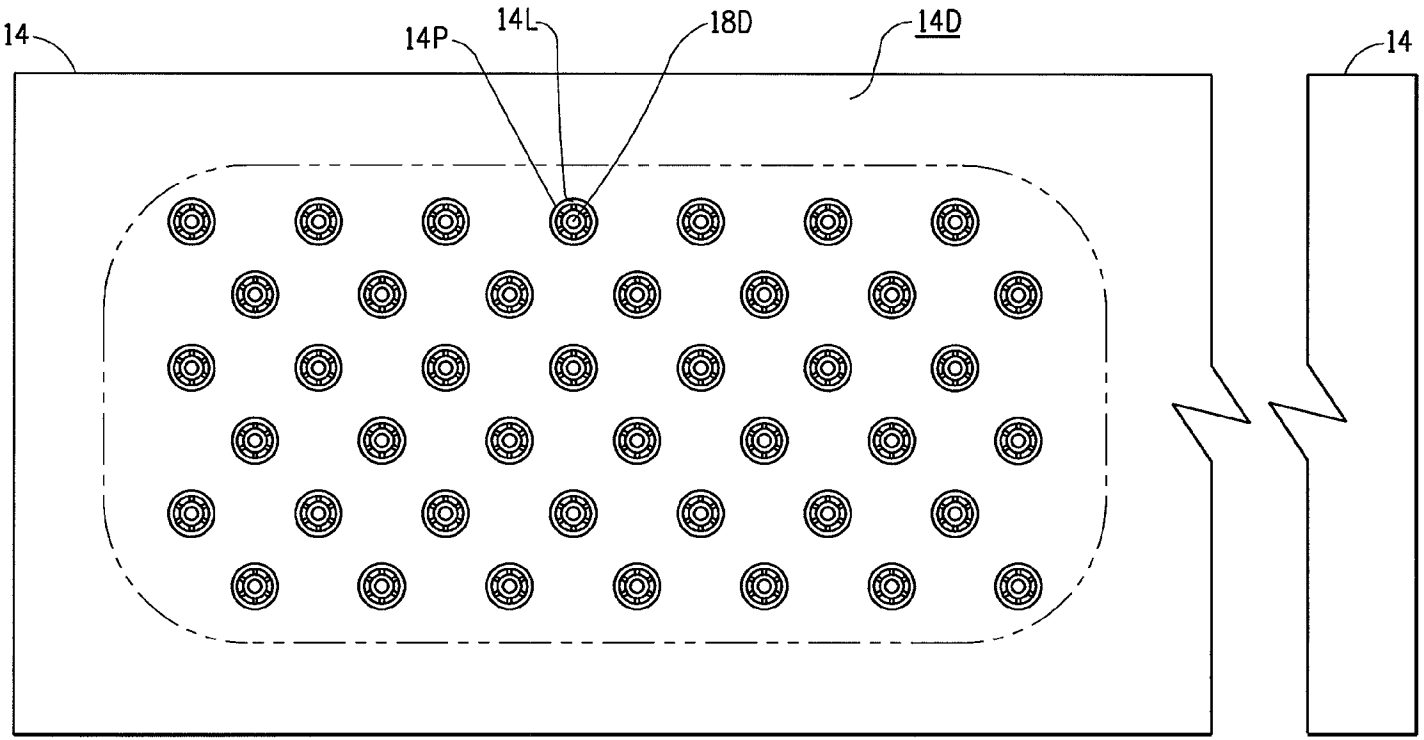
FIG. 7 is an elevation view taken along view lines 7-7 in FIG. 6.
Figure 8:
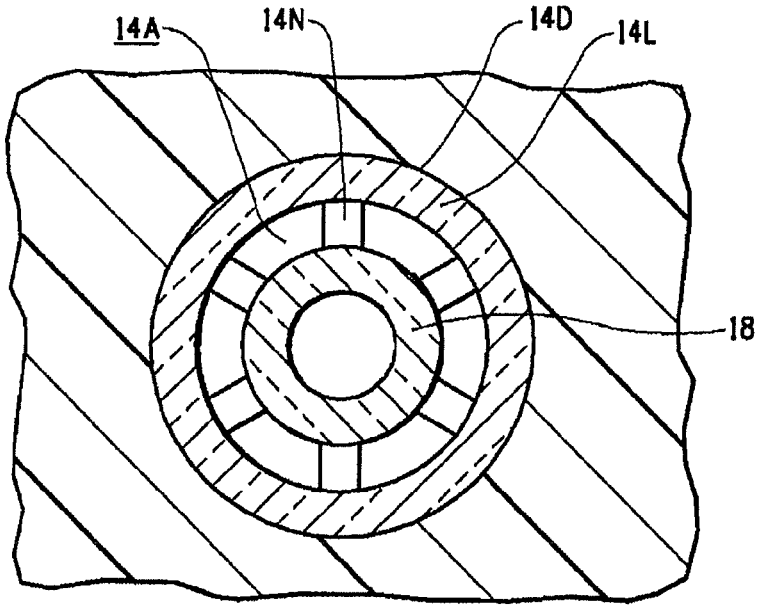
FIG. 8 is an elevation view taken along view lines 8-8 in FIG. 6.

FIGS. 1 through 5 show a first embodiment of a dispensing device 10 in accordance with the present invention for simultaneously dispensing a first and a second component of a two-component adhesive. An alternative embodiment of the dispensing device, indicated by the reference character 10', is shown in FIGS. 6 through 8.

As will be developed, either embodiment of the invention may be implemented in alternative versions.

The dispensing device 10 comprises a first manifold member 12 and a second manifold member 14. In the preferred arrangement the manifold members are stacked one atop the other. Although each manifold member 12, 14 is illustrated as a substantially rectanguloid block-like structure, it should be appreciated that the manifold members may take any convenient configuration.

A distribution chamber 12C, 14C is formed within each respective manifold member 12, 14. Each distribution chamber 12C, 14C is open along one side.

Each manifold member 12, 14 has a respective supply port 12S, 14S disposed in fluid communication with its distribution chamber 12C, 14C whereby a component of a two-part adhesive may be introduced into each respective chamber. The supply port 12S, 14S may also be connected to a source of pressurized dispensing fluid, such as a dual-barrel syringe, as will be discussed.

In the embodiment illustrated a tube support plate 16 connects the first and second manifold members 12, 14 and serves to close the open side of each chamber 12C, 14C. A portion of the surface of the tube support plate that registers with the chamber 12C has a recess 16R. A plurality of bores 16B is formed through the recessed portion of the tube support plate 16 for a purpose to be discussed.

Figure 2:
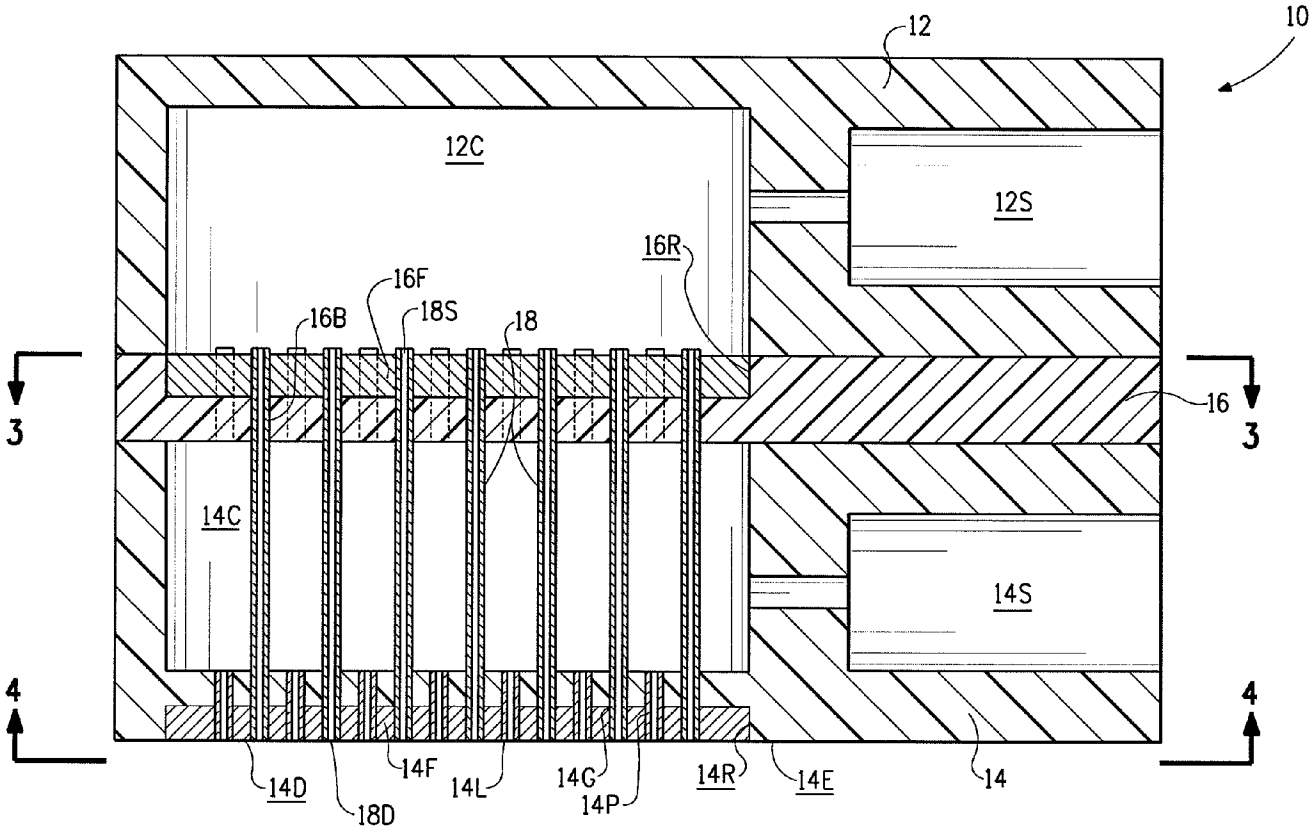
FIG. 2 is a section view taken along section lines 2-2 in FIG. 1 showing the dispensing device in the fully assembled configuration.
Figure 4:
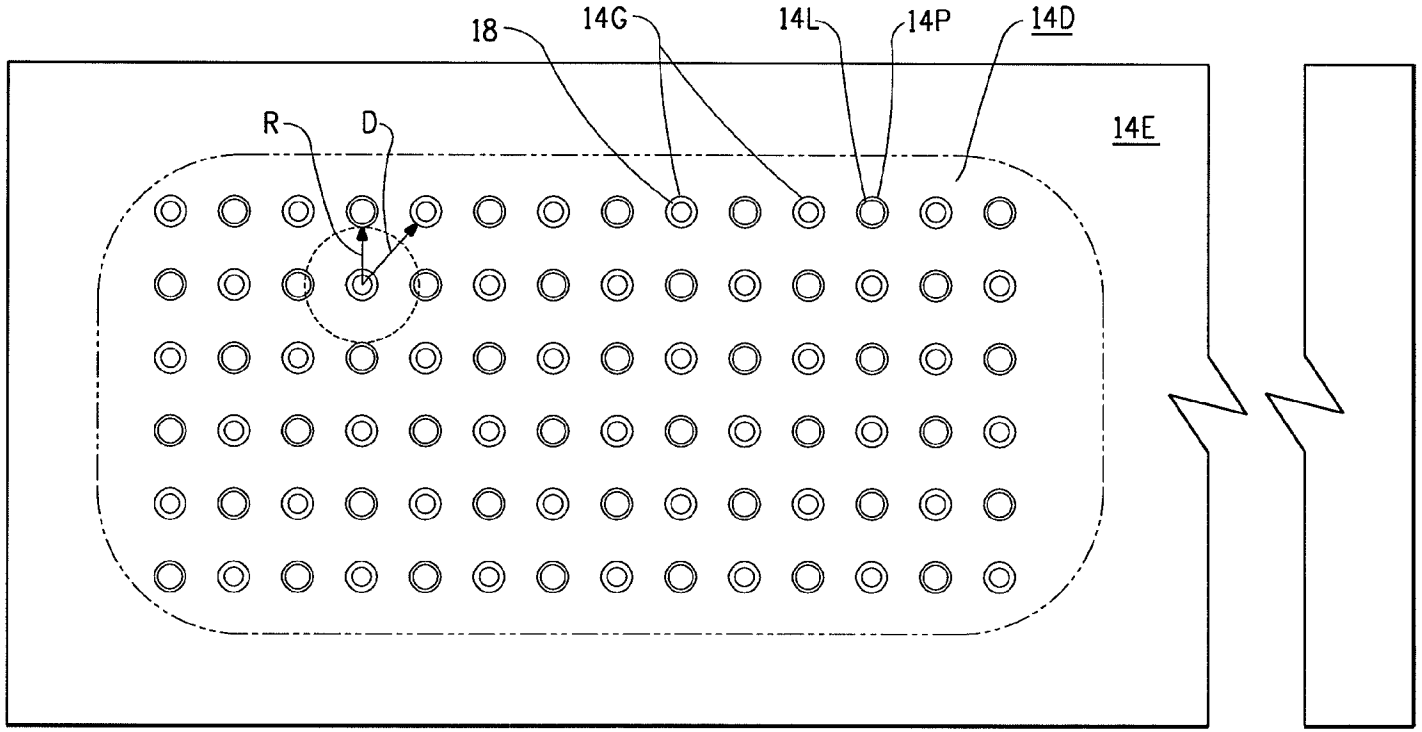
FIG. 4 is an elevation view taken along view lines 4-4 in FIG. 2.

As perhaps best seen in FIGS. 2 and 4 a portion of the exterior surface 14E of the second manifold member 14 has discharge area 14D defined thereon. In general, a plurality of openings 14G and a plurality of passages 14P extend through the second manifold member 14 and open onto and communicate with the discharge area 14D. The axis of each opening 14G in the second manifold member 14 is substantially collinearly aligned with the axis of a respective bore 16B in the tube support plate 16.

In the preferred instance the passages 14P are lined with a tubular liner 14L. To facilitate support for the liners 14L a portion of the discharge area 14D is recessed, as indicated at 14R. The liners 14L extend through the recessed portion 14R of the discharge area and are arranged such that the ends of the liners are substantially flush with the discharge area 14D. As will be developed, the liners 14L are held in position within the recess 14R by a support material 14F, such as a mass of epoxy, that fills the recess 14R and engages the portion of each of the liners 14L that passes therethrough.

In the fully assembled configuration of the device 10 (FIG. 2) the open interiors of the liners 14L are disposed in fluid communication with the second distribution chamber 14C. The interior of the liners 14L (or, interior of the passages 14P if the liners are omitted) each has a predetermined cross section such that the passages (whether lined or unlined) collectively present a predetermined total cross-sectional flow area to the second distribution chamber 14C.

Figure 3:
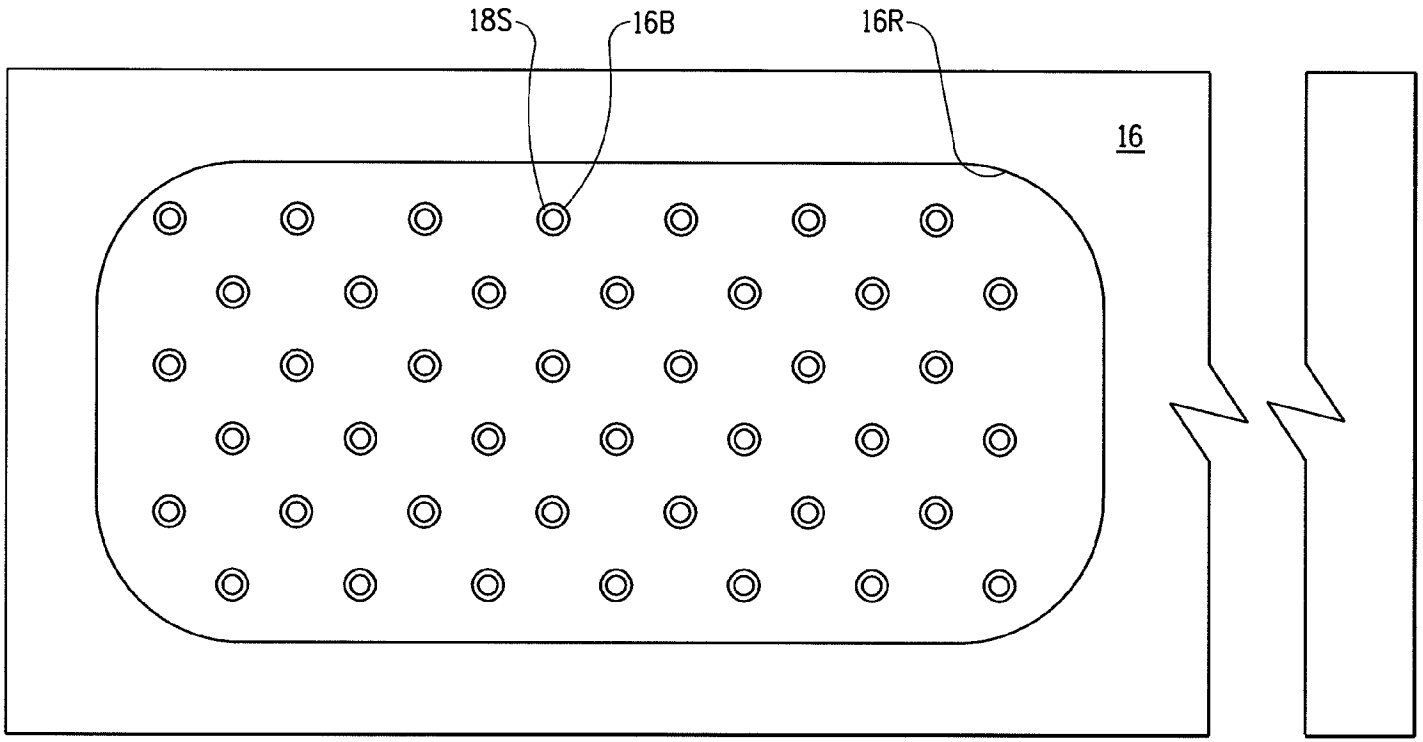
FIG. 3 is a section view taken along section lines 3-3 in FIG. 2.

The dispensing device includes a set of conveying tubes 18, each having a supply end 18S and a discharge end 18D. In the embodiment illustrated the conveying tubes 18 are supported within the dispensing device 10 by the tube support plate 16. The supply ends 18S of the tubes 18 are received within the bores 16B in the support plate 16 and are held in place by a support material 16F, such as a mass of epoxy, that fills the recess 16R and engages the portion of each tube that passes therethrough. The tubes 18 are held in position by the support material 16F such that the supply ends 18S of the tubes 18 are in fluid communication with the first distribution chamber 12C. Preferably, the supply ends 18S of the tubes 18 lie slightly proud of the surface of the support material 14F. As illustrated in FIG. 3 the open interior of each conveying tube 18 has a predetermined cross section area such that the tubes collectively present a predetermined total cross-sectional flow area to the first distribution chamber 12C.

The opposite end of each the conveying tube 18 passes through an opening 14G in second manifold member 14. Each conveying tube 18 extends through the recess 14R. The tubes 18 are held in position within the recess 14R by the support material 14F so that the discharge end 18D of each tube 18 opens onto and communicates with the discharge area 14D. The tubes 18 are also arranged to lie substantially flush with the discharge area 14D.

The manifold members 12, 14 as well as the support plate 16 may be formed from a suitable material, such as a polycarbonate plastic. The various chambers, ports openings, passages and bores are machined into the members 12, 14 and the plate 16. Preferably the conveying tubes 18 as well as the tubular liners 14L are implemented using "Peek" tubes, each cut to the appropriate length. Thus, the individual tubes 18 and the individual liners 14L exhibit the same interior cross sectional area. The liners 14L and the tubes 18 are set in the above described positions with respect to the members 12, 14 and the plate 16. When the tubes 18 and liners 14L are positioned as desired the support materials 14F, 16F are introduced into the respective recesses 14R, 16R, to secure the tubes 18 and liners 14L.

The relationship between the total cross-sectional flow area presented to the first distribution chamber 12C by the tubes 18 and the total cross-sectional flow area presented to the second distribution chamber 14C by the passages 14P (whether or not provided with a liner 14L) is determined in accordance with the ratio between the adhesive components received in the respective chambers 12C, 14C.

Depending upon the desired relative ratio of components the dispensing device 10 in accordance with the first embodiment of the invention may be implemented in one of two alternative versions.

For an adhesive having a 1:1 ratio between components, it is preferred that the total cross-sectional flow area presented to the first distribution chamber 12C by the tubes 18 is substantially equal to the total cross-sectional flow area presented to the second distribution chamber 14C. In practice, when the tubes 18 and liners 14L for the passages 14P are implemented using the same tubes, this relationship is able to be directly realized by utilizing substantially equal numbers of tubes and lined passages, since each tube and liner has a substantially equal interior cross sectional area. Of course, if the interior cross sectional area of the tubes and the passages (whether lined or unlined) are not equal, the relative number of tubes and passages (whether lined or unlined) is appropriately adjusted to provide substantial equality between the total cross sectional area presented to the first distribution chamber by the tubes 18 and the total cross sectional area presented to the second distribution chamber by the passages (whether lined or unlined).

An alternative version of the dispensing device 10 may be utilized if the ratio of the components is other than 1:1. In this instance the total cross-sectional flow area presented to the first distribution chamber 12C by the tubes 18 is different from (i.e., either greater than or less than) the total cross-sectional flow area presented to the second distribution chamber 14C by the passages (whether lined or unlined).

The inequality in total cross-sectional flow areas may be achieved by selecting the relative numbers and/or cross sections of the tubes and/or passages (whether lined or unlined) such that the ratio of the total cross-sectional flow areas presented to the first and second distribution chambers is in accordance with the desired ratio of components.

In accordance with the first embodiment of the invention the openings 14G and the passages 14P (whether lined or unlined) are laterally spaced with respect to each other in a predetermined pattern over the discharge area 14D. In general, the discharge ends 18D of the tubes 18 are interspersed among the passages 14P whereby the first and second components that respectively emanate from the first and second chambers via the tubes and passages are able to intermix with and diffuse into each other to a degree sufficient to cause a gellation action therebetween on the discharge area of the second manifold member.

In the preferred instance in which the tubes 18 and the liners 14L of the passages 14P are substantially equal in cross section and in which substantially equal numbers of tubes and passages are used, the discharge ends 18D of the tubes 18 are distributed in alternating fashion among the ends of the passages 14P in a regular matrix-like array. This arrangement is illustrated in FIG. 4.

As seen, the tubes 18 are laterally spaced from the passages 14P such that the discharge end 18D of any one tube is closer to one or more passages 14P than to the discharge end of another tube. Alternatively stated, a circle centered on the axis of any given tube 18 that intersects any laterally adjacent passage has a radius R that is less than the distance D from the center of the tube to another tube. A corresponding relationship regarding the distance between any given passage and another passage is likewise exhibited in the drawings. This interdigitation of tubes and passages insures that the components emanating therefrom are able to intermix in the desired fashion.

It should be understood, however, that the tubes and passages may be arranged in any other convenient alternative regular or irregular (i.e., random) patterns over the discharge area 14D of the member 14 when the numbers of tubes and passages are substantially different. Several illustrative alternative patterns are shown in FIG. 5.

Figure 5:
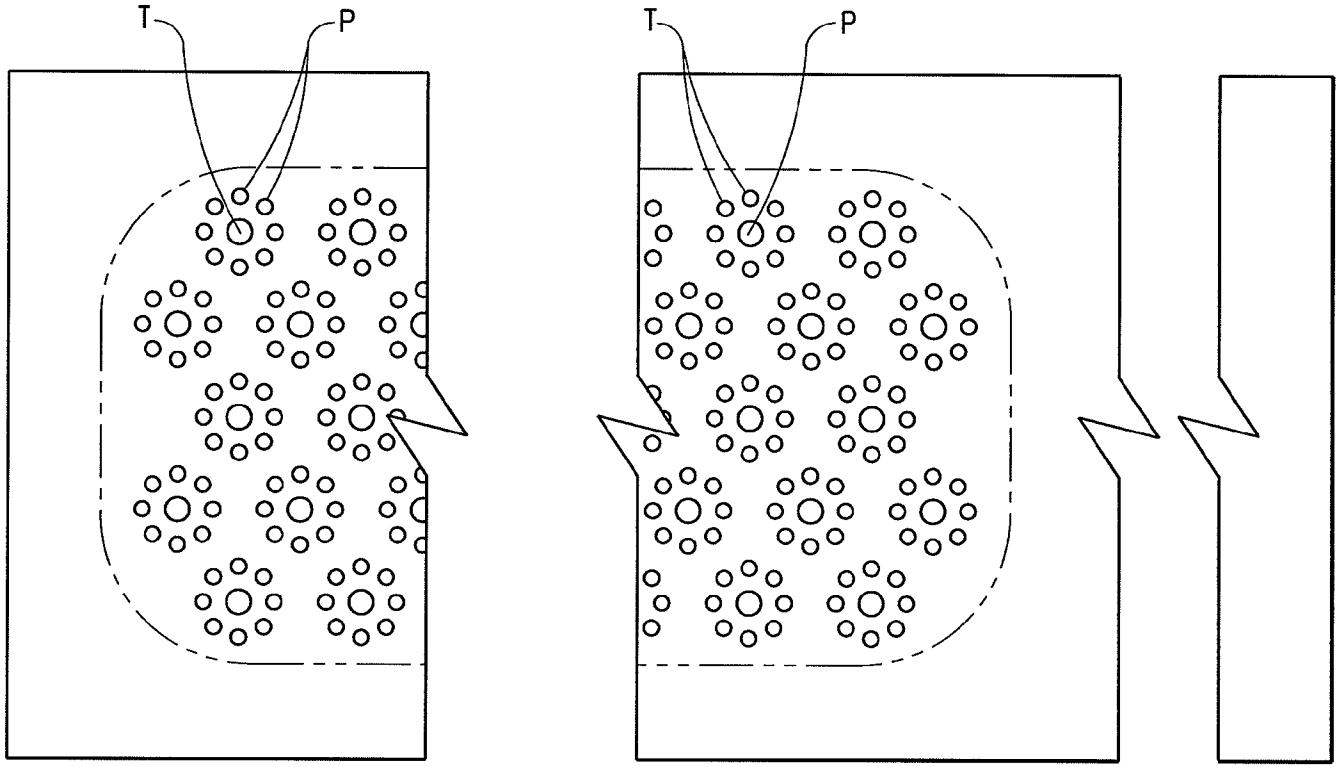
FIG. 5 is an elevation view generally similar to that in FIG. 4 illustrating alternative spacing arrangements for the tubes and passages over the discharge area of a dispensing device.

The arrangement shown in the left side of FIG. 5 may be used when the number of passages "P" is significantly greater than the number of tubes "T". Once again, it is seen that the discharge end of any one tube is closer to one or more passages than to the discharge end of another tube.

The converse relationship, where the number of tubes T is significantly greater than the number of passages P, is shown in the right hand portion of FIG. 5. In that case each passage is closer to the discharge end of one or more tubes than to another passage.

It is understood that when using arrangements like those shown in FIG. 5 the relative cross sectional areas of the individual tubes and passages should be appropriately selected to implement the desired relationship between the total cross-sectional flow areas presented to the respective distribution chambers so that the desired ratio between components may be achieved. Moreover, the relative numbers of tubes and passages depends upon the relative cross sectional area of each individual tube and each individual passage, with some number of the smaller-sized elements being required to present the interior cross section of one of the larger-sized elements.

In use, the components are caused to flow through the respective tubes and passages by pressurizing the respective chambers through the ports 12S, 14S. In a typical implementation the components are introduced into the respective chambers using a dual barrel syringe. The barrels are preferably equal in volume. The plungers of the syringes may be linked together or may be individually operable, as desired.

It should be understood, however, that any desired ratio of components may be achieved by suitably adjusting the relative sizes of the barrels, the chambers within the device, the flow rates of the components emanating from the barrels, the viscosities of the components, and/or the operating pressures.

An alternative embodiment of the dispensing device 10' in accordance with the present invention is shown in FIGS. 6 through 8.

In this embodiment each conveying tube 18 extends substantially concentrically through a respective passage 14P in the second manifold member 14, thereby to define a substantially annular flow space 14A within the passage. The passage may be lined or unlined. The annular flow spaces 14A collectively present a predetermined total cross-sectional flow area to the second distribution chamber 14C.

If desired the discharge end of each tube is supported within the passage by a standoff member 14N (FIG. 8) that interrupts the annular flow spaces 14A.

The passages are arranged over the discharge area such that first and second components that respectively emanate from the tubes and the flow spaces are able to intermix with each other on the discharge area of the second manifold member.

As in the case of the first embodiment the ratio of first and second components is governed by the ratio of the total cross-sectional flow area presented to the first distribution chamber by the tubes with respect to the total cross-sectional flow area presented to the second distribution chamber by the flow spaces.

For a 1:1 adhesive mixture the dispensing device 10' may be implemented in accordance with the first version (discussed earlier) in which the total cross-sectional flow area presented to the first distribution chamber 12C by the tubes 18 is substantially equal to the total cross-sectional flow area presented to the second distribution chamber by the flow spaces 14A.

The alternative version (also discussed above) of the dispensing device 10' may be utilized if the ratio of the components is other than 1:1. In this instance the total cross-sectional flow area presented to the first distribution chamber 12C by the tubes 18 is different from (i.e., either greater than or less than) the total cross-sectional flow area presented to the second distribution chamber 14C by the flow spaces 14A.

Those skilled in the art, having the benefit of the teachings of the present invention as hereinabove set forth may effect numerous modifications thereto. For example, for use in dispensing adhesives comprising more than two components device in accordance with the present invention may be extended to include additional manifold members and associated tubes and plates. These and all other modifications are to be construed as falling within the contemplation of the present invention as defined by the appended claims.

What is claimed is:

1. A dispensing device for dispensing a first and a second component of an adhesive, the dispensing device comprising:

a first and a second manifold member, each manifold member having a distribution chamber therein, the second manifold member having an exterior surface thereon, a portion of the exterior surface of the second manifold member having a discharge area defined thereon;

a set of conveying tubes each having a supply end and a discharge end, the conveying tubes being supported within the dispensing device such that the supply ends thereof are disposed in fluid communication with the first distribution chamber, the conveying tubes collectively presenting a predetermined total cross-sectional flow area to the first distribution chamber;

an array of passages extending through the second manifold member, the passages being disposed in fluid communication with the second distribution chamber and with the discharge area;

each conveying tube extending substantially concentrically through a respective passage thereby to define a substantially annular flow space within the passage, the annular flow spaces collectively presenting a predetermined total cross-sectional flow area to the second distribution chamber;

wherein the total cross-sectional flow area presented to the first distribution chamber by the tubes is substantially equal to the total cross-sectional flow area presented to the second distribution chamber by the annular flow spaces;

the passages being arranged over the discharge area such that first and second components that respectively emanate from the tubes and the flow spaces are able to intermix with each other on the discharge area of the second manifold member;

wherein the first and second components of the adhesive are in a predetermined ratio with respect to each other, and wherein the ratio of the total cross-sectional flow area presented to the first distribution chamber by the tubes to the total cross-sectional flow area presented to the second distribution chamber by the annular flow spaces is substantially equal to the predetermined ratio of the components.

2. The dispensing device of claim 1 wherein each passage is lined by a hollow tubular liner, the tubular liners cooperating with the conveying tubes thereby to define the annular flow spaces.

3. The dispensing device of claim 2 further comprising:

a standoff disposed in at least one of the flow spaces between the tube in that flow space and the liner in that passage.

4. The dispensing device of claim 1 further comprising:

a standoff disposed in the flow space defined in at least one of the passages.

5. The dispensing device of claim 1 wherein each manifold member has a supply port formed therein, each supply port being disposed in fluid communication with a respective one of the first and second distribution chambers, each supply port being adapted to receive one of the components of the adhesive and convey the same into its respective manifold member.

6. The dispensing device of claim 1 further comprising:

a tube support plate disposed between the first and the second manifold members;

the tube support plate receiving the supply end of each of the conveying tubes and supporting the same such that the supply ends of the conveying tubes are disposed in fluid communication with the first distribution chamber.

7. A dispensing device for dispensing a first and a second component of an adhesive, the dispensing device comprising:

a first and a second manifold block, the blocks being stacked one atop the other, each manifold block having a distribution chamber therein, the second manifold block having a planar exterior surface thereon, a portion of the exterior planar surface of the second manifold block having a discharge area defined thereon;

a tube support plate disposed between the first and the second manifold members;

a set of conveying tubes, each conveying tube having a supply end and a discharge end, the conveying tubes being supported by the tube support plate such that the supply ends of the conveying tubes are disposed in fluid communication with the first distribution chamber, the conveying tubes collectively presenting a predetermined total cross-sectional flow area to the first distribution chamber;

an array of passages extending through the second manifold member, each passage being lined by a tubular liner, each liner being disposed in fluid communication with the second distribution chamber and with the discharge area;

each conveying tube extending substantially concentrically through a respective lined passage thereby to define a substantially annular flow space within the passage, the annular flow spaces collectively presenting a predetermined total cross-sectional flow area to the second distribution chamber;

the total cross-sectional flow area presented to the first distribution chamber by the tubes is substantially equal to the total cross-sectional flow area presented to the second distribution chamber by the annular flow spaces; the passages being arranged over the discharge area such that first and second components that respectively emanate from the tubes and the flow spaces are able to intermix with each other on the discharge area of the second manifold member;

wherein the first and second components of the adhesive are in a predetermined ratio with respect to each other, and wherein the ratio of the total cross-sectional flow area presented to the first distribution chamber by the tubes to the total cross-sectional flow area presented to the second distribution chamber by the annular flow spaces is substantially equal to the predetermined ratio of the components.

8. A dispensing device for dispensing a first and a second component of an adhesive, the dispensing device comprising:

a first and a second manifold member, each manifold member having a distribution chamber therein, the second manifold member having an exterior surface thereon, a portion of the exterior surface of the second manifold member having a discharge area defined thereon;

a set of conveying tubes each having a supply end and a discharge end, the conveying tubes being supported within the dispensing device such that the supply ends thereof are disposed in fluid communication with the first distribution chamber, the conveying tubes collectively presenting a predetermined total cross-sectional flow area to the first distribution chamber;

an array of passages extending through the second manifold member, the passages being disposed in fluid communication with the second distribution chamber and with the discharge area;

each conveying tube extending substantially concentrically through a respective passage thereby to define a substantially annular flow space within the passage, the annular flow spaces collectively presenting a predetermined total cross-sectional flow area to the second distribution chamber;

wherein the total cross-sectional flow area presented to the first distribution chamber by the tubes is different from to the total cross-sectional flow area presented to the second distribution chamber by the annular flow spaces;

the passages being arranged over the discharge area such that first and second components that respectively emanate from the tubes and the flow spaces are able to intermix with each other on the discharge area of the second manifold member;

wherein the first and second components of the adhesive are in a predetermined ratio with respect to each other, and wherein the ratio of the total cross-sectional flow area presented to the first distribution chamber by the tubes to the total cross-sectional flow area presented to the second distribution chamber by the annular flow spaces is substantially equal to the predetermined ratio of the components.

9. The dispensing device of claim 8 wherein the total cross-sectional flow area presented to the first distribution chamber by the tubes is greater than the total cross-sectional flow area presented to the second distribution chamber by the annular flow spaces.

10. The dispensing device of claim 9 wherein the ratio of the total cross-sectional flow area presented to the first distribution chamber by the tubes with respect to the total cross-sectional flow area presented to the second distribution chamber by the annular flow spaces is at least (1.25:1).

11. The dispensing device of claim 8 wherein the total cross-sectional flow area presented to the first distribution chamber by the tubes is less than the total cross-sectional flow area presented to the second distribution chamber by the annular flow spaces.

12. The dispensing device of claim 11 wherein the ratio of the total cross-sectional flow area presented to the first distribution chamber by the tubes with respect to the total cross-sectional flow area presented to the second distribution chamber by the annular flow spaces is at least (1:1.25).

13. The dispensing device of claim 8 wherein each passage is lined by a hollow tubular liner, the tubular liners cooperating with the conveying tubes thereby to define the annular flow spaces.

14. The dispensing device of claim 13 further comprising:

a standoff disposed in at least one of the flow spaces between the tube in that flow space and the liner in that passage.

15. The dispensing device of claim 8 further comprising:

a standoff disposed in the flow space defined in at least one of the passages.

16. The dispensing device of claim 8 wherein each manifold member has a supply port formed therein, each supply port being disposed in fluid communication with a respective one of the first and second distribution chambers, each supply port being adapted to receive one of the components of the adhesive and convey the same into its respective manifold member.

17. The dispensing device of claim 8 further comprising:

a tube support plate disposed between the first and the second manifold members;

the tube support plate receiving the supply end of each of the conveying tubes and supporting the same such that the supply ends of the conveying tubes are disposed in fluid communication with the first distribution chamber.

* * * * *